US009371215B2

(12) United States Patent
Willim

(10) Patent No.: US 9,371,215 B2
(45) Date of Patent: Jun. 21, 2016

(54) METHOD FOR ERECTING A CRANE BOOM

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 913 days.

(21) Appl. No.: 12/290,247

(22) Filed: Oct. 29, 2008

(65) Prior Publication Data

US 2009/0127219 A1 May 21, 2009

(30) Foreign Application Priority Data

Oct. 29, 2007 (DE) ..... 10 2007 051 540
Nov. 22, 2007 (DE) ..... 10 2007 056 289

(51) Int. Cl.

| | |
|---|---|
| ***B66C 13/06*** | (2006.01) |
| ***B66C 23/68*** | (2006.01) |
| ***B66C 23/687*** | (2006.01) |
| ***B66C 23/82*** | (2006.01) |
| ***B66C 23/70*** | (2006.01) |

(52) U.S. Cl.
CPC ..... *B66C 23/82* (2013.01); *B66C 23/702* (2013.01); *B66C 13/06* (2013.01)

(58) Field of Classification Search
USPC ..... 212/169, 175, 176, 177, 294, 296, 297, 212/299, 300, 255, 258, 260–262, 264, 270
See application file for complete search history.

(56) References Cited

U.S. PATENT DOCUMENTS

| | | | | |
|---|---|---|---|---|
| 3,732,988 | A * | 5/1973 | Lamer | 212/300 |
| 3,792,781 | A * | 2/1974 | Blase et al. | 212/178 |
| 3,968,884 | A | 7/1976 | Johnson et al. | |
| 4,491,228 | A * | 1/1985 | Poock et al. | 212/239 |
| 6,062,404 | A * | 5/2000 | Erdmann | 212/292 |
| 7,516,858 | B2 | 4/2009 | Willim | |
| 2004/0040926 | A1 | 3/2004 | Irsch et al. | |
| 2004/0124167 | A1 | 7/2004 | Willim | |
| 2006/0065616 | A1* | 3/2006 | Diehl | 212/300 |
| 2006/0096940 | A1* | 5/2006 | Willim | 212/300 |

FOREIGN PATENT DOCUMENTS

| | | | |
|---|---|---|---|
| DE | 30422287 | A * | 6/1982 |
| DE | 20218971 | | 4/2004 |
| DE | 102005049606 | | 4/2007 |
| FR | 2416861 | | 9/1979 |
| JP | 8-295490 | A * | 11/1996 |
| JP | 10-194676 | A * | 7/1998 |
| JP | 10-310372 | A * | 11/1998 |
| JP | 10316366 | | 12/1998 |
| JP | 11-322278 | A * | 11/1999 |

(Continued)

OTHER PUBLICATIONS

Search Report for European Application No. EP 08016227.4-1256.
Dr. Ing. Oliver Fries, Terex-Demag GmbH & Co. KG, Zweibrucken, "Systems to increase the lifting capacity for booms of mobile cranes," 11th Crane Congress, May 16, 2003, Dresden Technical University, LWE- No. 86.4.0, Jul. 27, 2010, pp. 59-69.

*Primary Examiner* — Sang Kim
*Assistant Examiner* — Juan Campos, Jr.
(74) *Attorney, Agent, or Firm* — Dilworth & Barrese, LLP

(57) ABSTRACT

This invention relates to a method for erecting a main boom of a truck crane, which at least consists of a telescopic boom, with a fly jib which is braced via bracing trestles and bracing rods, and with a spatial boom bracing. In accordance with the invention, the main boom is braced by means of the spatial bracing before being completely connected with the fly jib.

21 Claims, 5 Drawing Sheets

(56) References Cited

FOREIGN PATENT DOCUMENTS

JP 2001-151469 A * 6/2001
JP 2002255478 9/2002
SU 969650 A * 10/1982

* cited by examiner

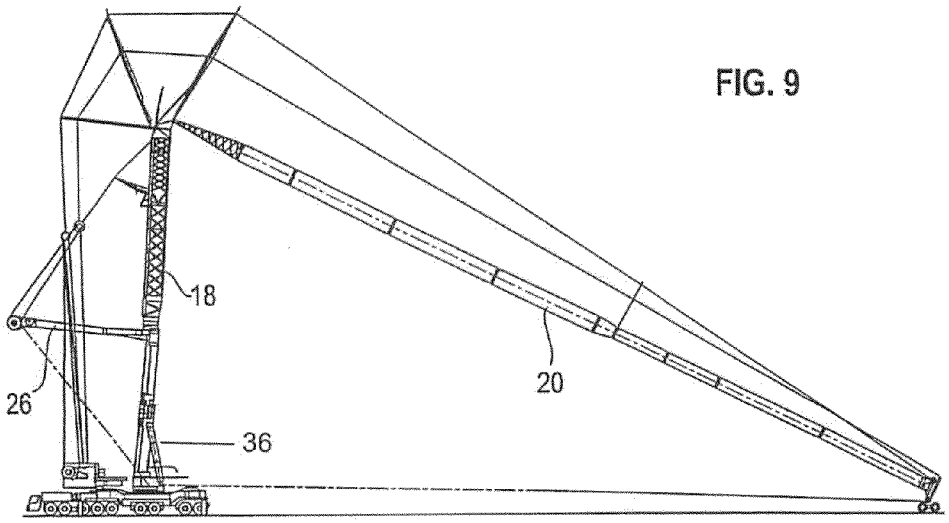
FIG. 9
FIG.10
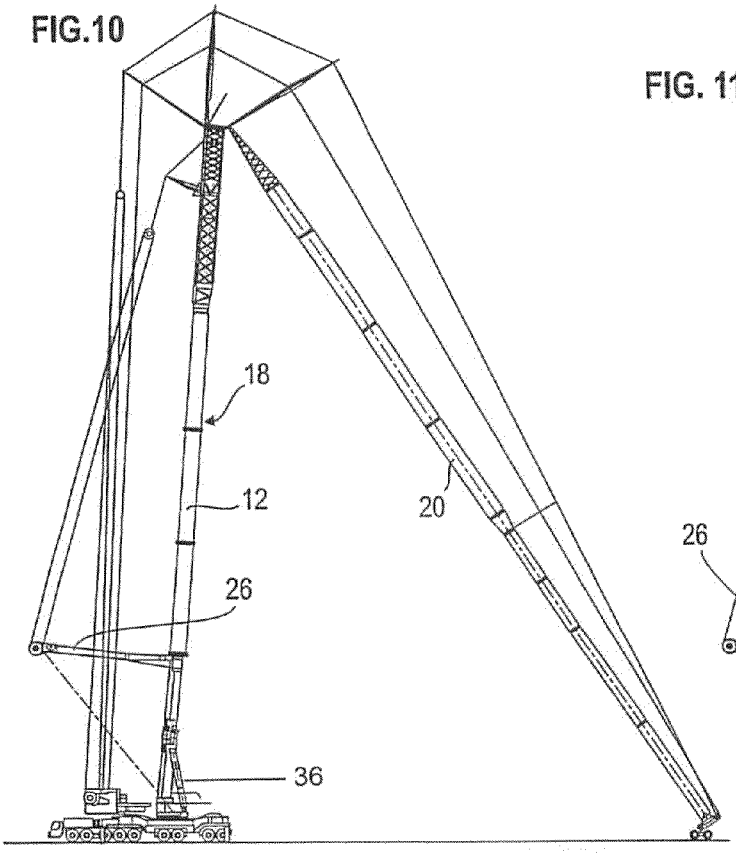
FIG. 11
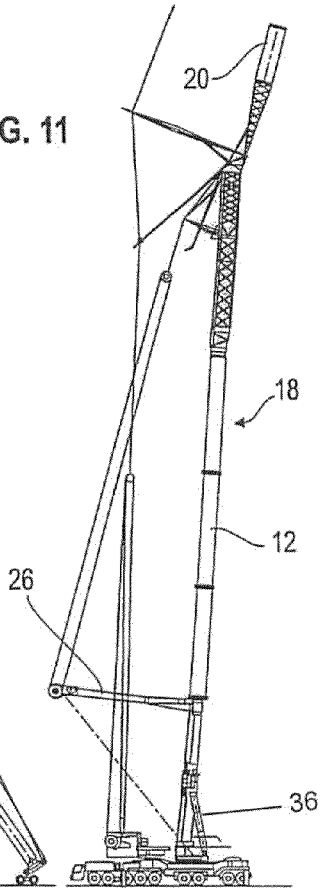

METHOD FOR ERECTING A CRANE BOOM

BACKGROUND OF THE INVENTION

This invention relates to a method for erecting a main boom of a truck crane, which at least consists of a telescopic boom, with a fly jib which is braced via bracing trestles and bracing rods, and with a spatial boom bracing.

Frequently, very high hoisting heights and outreaches are required. The same go beyond the working ranges of telescopic cranes. Also because of possibly disturbing edges, fly jibs are mounted on the telescopic boom in such cases. The fly jibs can achieve very great lengths, which even can extend far beyond the length of the main boom itself. Such fly jibs can consist of a luffing jib or a fixed jib. When using correspondingly long fly jibs, it is absolutely necessary to provide bracing trestles and bracing rods, which extend from the bracing trestle to the tip of the fly jib.

In the case of high disturbing edges, hoisting heights of up to 170 m are achieved. With such long boom systems, a spatial bracing regularly is used at the telescopic boom for stabilization. From DE 20 2004 017 771 U1, an eccentric attachment of the bracing to the main boom tip has already become known, which likewise is used in systems with such high hoisting heights.

At present, large telescopic cranes frequently are designed such that they can be operated with a spatial bracing. Thus, in certain operating positions (for instance when erecting the main boom into a steep position), they can only reach the highest load moments with tensioned spatial bracing. Especially this operating position frequently exists when using a boom system which consists of a main boom with attached fly jib. Without the tensioned spatial bracing, the total stability of the main boom is greatly reduced. It should be noted here that the spatial bracing exclusively extends over the main boom and a possibly existing main boom extension. The fly jib, however, is held in the luffing plane by means of bracing rods and, in the case of a particularly great length, possibly by means of additional intermediate bracings.

During assembly of such large telescopic cranes, the fly jib usually is mounted completely without the foot piece. The head piece rests on a carriage, by means of which it can roll on the ground.

On the other hand, the telescopic boom is connected with the telescopic boom extensions and the adapter pieces. The spatial bracing is mounted, but not yet tensioned. There can also be effected an eccentric attachment of the bracing rods to the outer end of the main boom in accordance with DE 20 2004 017 771 U1.

The foot piece of the fly jib and the bracing trestles are attached to the main boom. The bracing rods are deposited on the fly jib and connected with the end of the head piece of the fly jib and with a bracing trestle. The foot piece of the fly jib, the bracing trestles and the bracing rods together form a transport unit. In the bracing rods, an element is provided, which is connectable with the end of the foot piece of the fly jib. Since the connection between the bracing rods and the foot piece is required for dismantling the entire boom, this connection is present during reassembly and thus need not be made again. The foot piece of the fly jib is connected with the mounted fly jib at the upper bolting points.

To be able to subsequently insert the lower bolts, a connection between bracing trestle and foot piece of the fly jib is made via the bracing rods. By means of the associated adjusting winch, the bracing trestles can now be luffed. As a result, the foot piece is lifted, until the foot piece of the fly jib can be connected with the premounted fly jib.

Subsequently, the connection of the bracing rod with the foot piece of the fly jib is separated again and the normal connection is made from the bracing trestle to the end of the luffing jib with the bracing rods. At this time, the telescopic jib of the main boom is not yet extended to the operating length.

The main boom telescoped in now is erected into a steep position, wherein the outer end of the fly jib at the bottom rests on the carriage. For this purpose, the fly jib can swivel about the pivot points at the main boom. In this way, the moment caused by the fly jib is minimized, and the bearing friction inside the telescope advantageously is reduced. At this time, however, the outer end of the boom system is free and is not supported in any way. The entire guidance of the long boom system is performed by the main boom.

Thereupon, the main boom is telescoped out to the desired length. For this purpose, the boom tray to be telescoped must each be bolted to the telescopic cylinder. Upon telescoping out, bolting of the respective telescopic stages is effected, wherein the connection of the deploying cylinder with the telescopic stages is separated. Finally, the spatial bracing is tensioned. The boom system now reaches its maximum load capacity.

During assembly of the fly jib, the greatest load for the smallest telescopic section occurs in an approximately horizontal position. Here, the entire foot weight of the fly jib (plus the bracing trestles, telescopic boom extensions and corresponding adapter pieces) with the great lever arm (e.g. length of the telescopic boom extension plus corresponding adapter pieces and foot piece of the fly jib) rests on the cross-section of the smallest telescopic stage. Even if the same is retracted, it nevertheless forms the weakest link in the main boom. This weakest link limits the maximum admissible lengths of the boom system, especially the length of the fly jib, due to the forces and moments occurring during this mounting operation.

SUMMARY OF THE INVENTION

Therefore, it is the object of the invention to create a method for erecting a crane boom, which is developed such that comparatively greater boom systems can be mounted and erected.

In accordance with the invention, this object is solved by a method with the central erecting steps herein. The prior art method now is modified in accordance with the invention to the effect that before being connected with the fly jib, the main boom is braced by means of the spatial bracing. This step relieves the smallest telescopic stage, since the moment acting on this cross-section is distinctly reduced by the bracing. As a result, the smallest telescopic stage is relieved, which in turn leads to the fact that comparatively longer boom systems can be erected without an increase in the cross-section of the telescopic stage.

Preferred aspects of the invention can be taken from the description herein.

Accordingly, when erecting the crane, the bracing trestles and the isolated foot piece of the fly jib first are mounted to the main boom.

Advantageously, the spatial bracing then can be mounted and tensioned, in order to connect the isolated foot piece of the fly jib with the fly jib, wherein the fly jib is movably mounted on one or more carriages.

Thus, the main boom can be subjected to a higher load due to the tensioned spatial bracing.

In accordance with an advantageous aspect of the invention, the main boom subsequently is brought into a steep position and upon release of the spatial bracing telescoped out to the desired length. In this position, the main boom no longer is loaded so much, so that the spatial bracing can be released again in this position. The pivotally mounted end of the fly jib also is lifted, and the outer end of the fly jib is freely rolling on the at least one carriage.

Upon extending the main boom to the desired length, the telescopic stages of the main boom advantageously are bolted to each other. Subsequently, the spatial bracing advantageously is tensioned again, before the fly jib is erected. In this way, the stability of the main boom during erection of the fly jib can substantially be improved. These method steps are subject-matter of a parallel patent application of the applicants, which was filed as a German patent application with the same priority. Reference is made here to this disclosure.

In the long boom systems, as they are employed in the present method for erecting the crane boom, the maximum erectable boom length frequently is limited by the capacity of the at least one luffing cylinder. It should be considered that erecting boom systems is a mounting operation which does not fall under the guidelines for operating cranes. The monitoring systems to avoid an overload are not active during assembly. To support the luffing cylinder during assembly and to prevent an overload of the luffing cylinder, an auxiliary crane is used in accordance with a particularly advantageous aspect of the invention, which supports the erection of the main boom by means of the luffing cylinders provided for this purpose. During erection, the auxiliary crane introduces a further hoisting force into the boom system at a defined point. In this way, the at least one luffing cylinder of the crane to be assembled is relieved.

Advantageously, the auxiliary crane is abutted against at least one bollard arranged at the main boom. The bollard is of such a shape that an automatic engagement and disengagement of the abutment side is possible.

Due to luffing up, the lever arm of the loads each present in the boom system is reduced. What is more important, however, is the improvement of the geometrical and lever conditions at the luffing cylinder itself. Upon reaching a defined boom angle, for instance, the auxiliary crane thus can again be separated from the boom.

In accordance with a further advantageous aspect of the invention, an auxiliary cable is connected with the hoisting cable during erection, which is unwound from an auxiliary winch and on which a defined tension is applied by the same.

BRIEF DESCRIPTION OF THE DRAWINGS

Further details and advantages of the invention will be explained in detail by means of the embodiments illustrated in the drawing, in which:

FIGS. 1 to 11: show a truck crane with telescopic boom in the different mounting situations in accordance with the invention.

DESCRIPTION OF THE PREFERRED EMBODIMENTS

Figure 1:
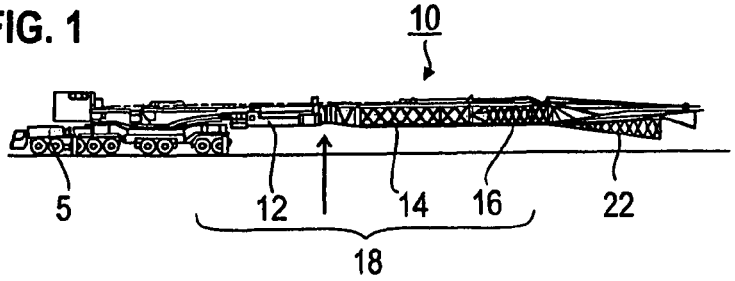
Figure 2:
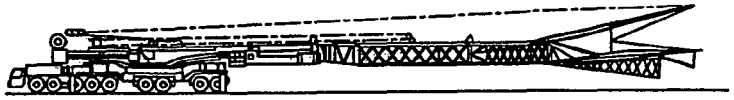
Figure 3:
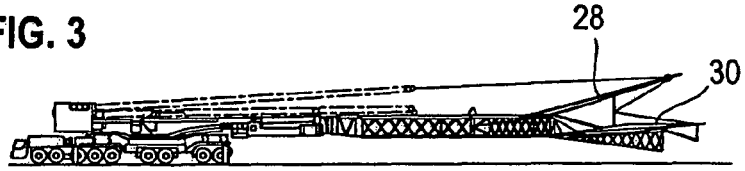
Figure 4:
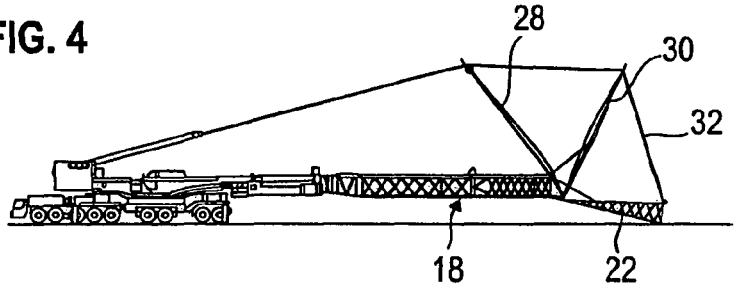

With reference to FIGS. 1 to 11, the method of the invention for erecting a crane boom 10 of a mobile crane 5 can be explained. The crane boom 10 in accordance with the embodiment shown here consists of a telescopic boom 12, a telescopic boom extension 14 and an adapter piece 16, which together form the main boom 18, and of an attached fly jib 20, which comprises a detachable foot piece 22. As is not shown in detail in the Figures, the fly jib 20 first is mounted completely without the foot piece 22, with the head piece of the fly jib 20 resting on a carriage 24.

As shown in FIG. 1, the telescopic boom 12 is connected with the telescopic boom extension 14 and the adapter piece 16. The spatial bracing 26 is mounted, but not yet tensioned. The foot piece 22 and the bracing trestles 28, 30 are attached to the main boom 18. The bracing rods 32 between the bracing trestle 30 and the end of the foot piece already are present. They are deposited on the fly jib. Finally, a connection is made between the bracing rods belonging to the transport unit and the outer end of the fly jib (head piece). The foot piece 22 of the fly jib 20 is connected with the mounted fly jib 20 at the upper bolting points 34 (cf. up to FIG. 5).

To be able to now insert the bolts, a connection is made between the bracing trestle 30 and the foot piece 22 of the fly jib via the bracing rods 32. By means of an adjusting winch, the bracing trestles 28 and 30 now can be luffed. In this way, the foot piece 22 is lifted, until the foot piece 22 of the fly jib can be connected with the premounted fly jib 20 at the lower bolting points.

Subsequently, the connection of the bracing rods with the foot piece of the fly jib is separated again.

Figure 5:
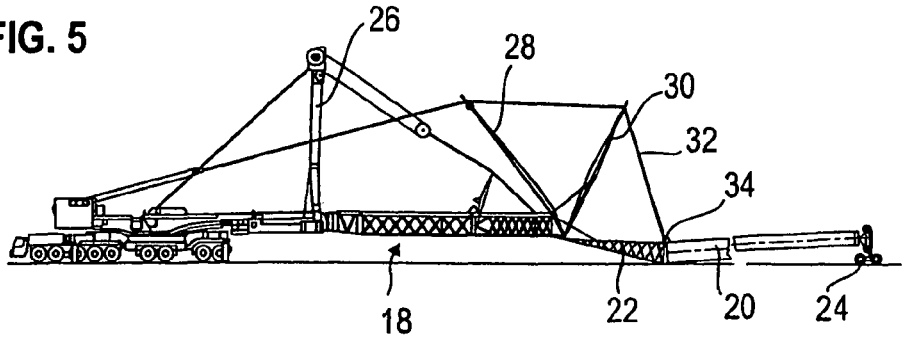

It is decisive that, as shown in FIG. 5, the spatial bracing 26 is tensioned before the main load acts on the main boom 18 during closure of the fly jib 20. By tensioning the spatial bracing of the main boom, the smallest cross-section of the main boom is relieved.

Figure 6:
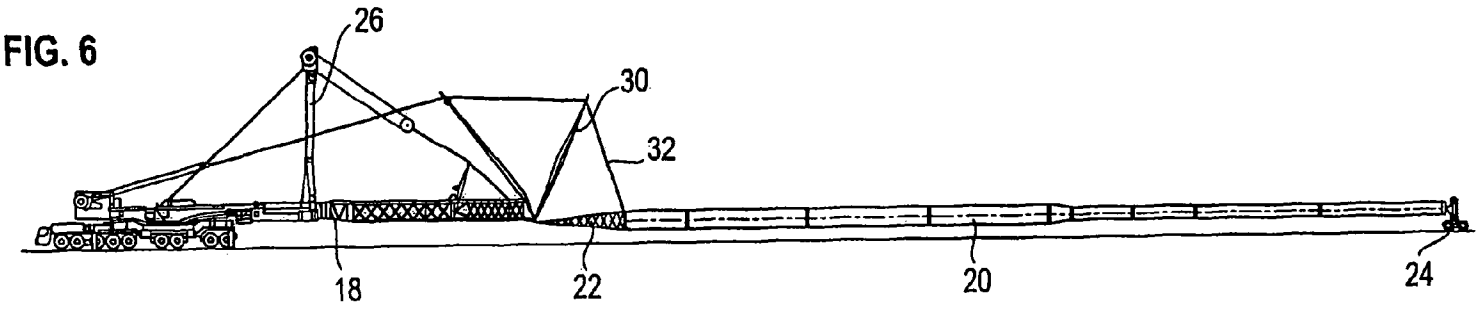

As shown in FIG. 6, the fly jib 20 only is attached completely, i.e. the lower bolts are inserted, after tensioning the spatial bracing 26. Thus, the foot weight of the fly jib, which the main boom must take, is increased.

Figure 7:
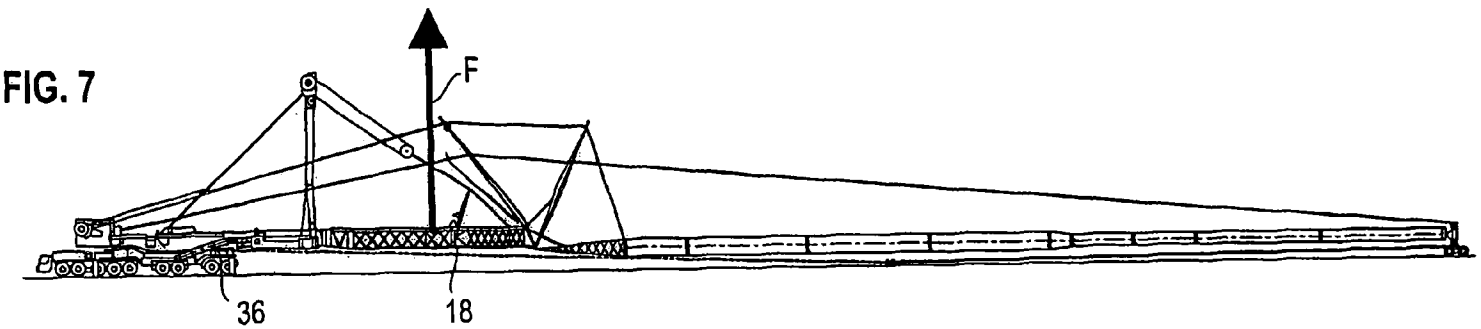
Figure 8:
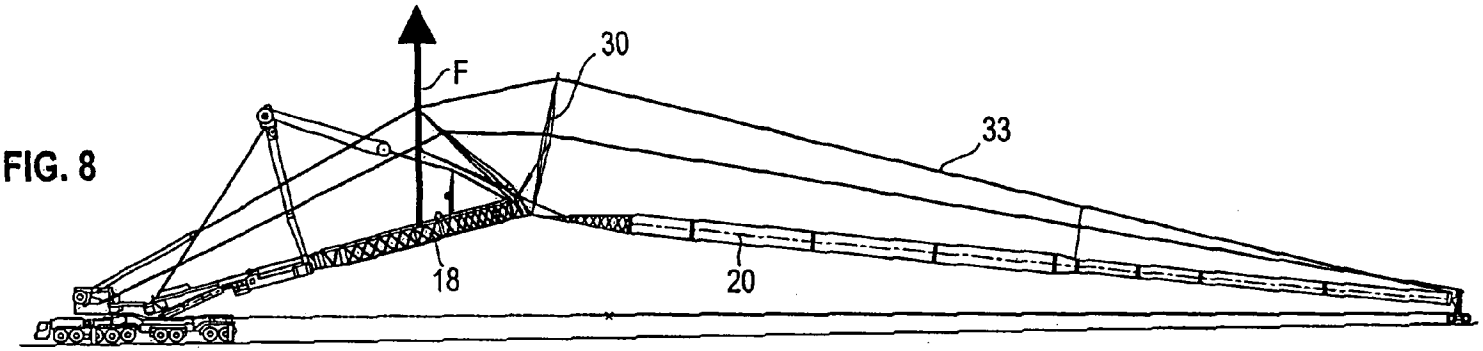

Subsequently, the main boom 18 now is brought into a steep position. For this purpose, a luffing cylinder 36 initially is provided. To support this luffing cylinder, the same is supported by a non-illustrated auxiliary crane during erection of the main boom 18 (cf. hoisting force in the direction of arrow F as shown in FIGS. 7 and 8).

In both crane operator cabins, the load taken up is displayed. In accordance with his display in the crane operator cabin, the operator of the auxiliary crane introduces a force lying within defined ranges into the boom 18 of the main crane during this erecting and depositing operation. In the crane operator cabin of the main crane, the utilization of the luffing cylinder is displayed, partly also monitored, and maintained within the admissible range. The procedure specified here with respect to the erection of the crane is performed inversely when depositing the crane.

A permanent communication between the crane operators must be ensured. During erection, a common control also can coordinate the movement of the hoisting cylinder 36 on the one hand and the elevation of the non-illustrated auxiliary crane on the other hand.

Figure 14:
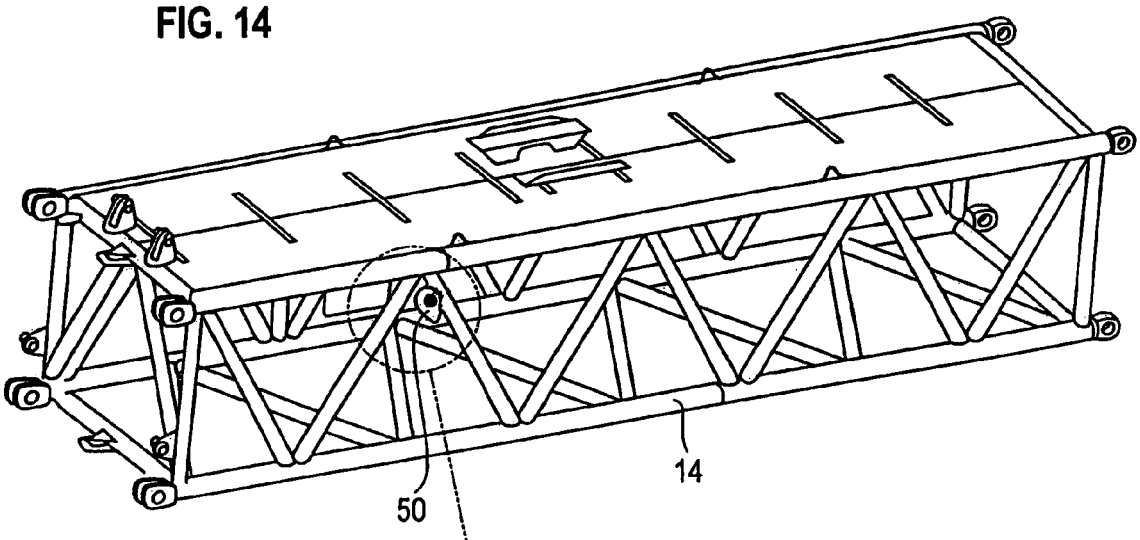
FIGS. 14 and 15: show a perspective representation of a part of the main boom.
Figure 15:
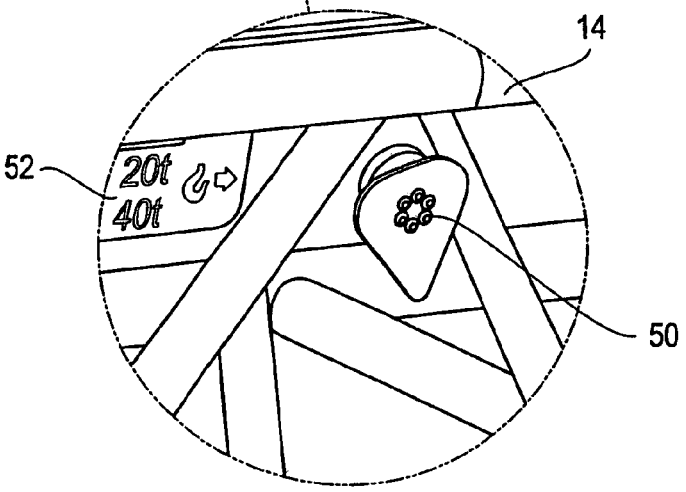

Advantageously, the pressure of the luffing cylinder 36 of the main crane is displayed. The pressure also is monitored against a specified limit value (only when depositing the boom system). This simplifies reaching the luffing position, in which the support of the auxiliary crane is required. The crane operator swivels down the fly jib, so that it again obtains guidance and relief via the carriage at the head piece of the fly jib. After completely telescoping in the main boom, the crane operator is luffing down the main boom, until the movement is stopped by the overload monitoring means of the luffing cylinder. Now, the cable at the hook of the auxiliary crane is hooked in at a special bollard 50, which according to FIGS. 14 and 15 is laterally arranged at a telescopic boom extension 14 of the main boom. The special bollard 50 can be arranged on both sides of the telescopic boom extension 14. Here, an indication of the force with which the auxiliary crane must support is provided. For this purpose, the sign 52 is used. This indication can be recognized by the operator of the auxiliary crane.

As a result of luffing up, the lever arm of the loads each present in the boom system is reduced. What is more important, however, is the improvement of the geometrical and lever conditions at the luffing cylinder 36. Thus, the auxiliary crane can again be separated from the boom upon reaching a defined boom angle.

Due to the support of the auxiliary crane, the cross-section of the smallest telescopic stage in the main boom can be relieved in addition to the spatial bracing.

As shown in FIG. 8, bracing rods 33 are arranged at the bracing trestle 30, which are connected with the head of the fly jib 20.

As shown in FIG. 9, the main boom 18 has reached its erected position. In this position, the spatial bracing 26 can be released again. Subsequently, the telescopic boom 12 of the main boom 18 is telescoped out until it has reached its desired length, as is shown in FIG. 10. After correspondingly bolting the individual telescopic stages of the telescopic boom 12, the spatial bracing 26 is tensioned again.

Figure 12:
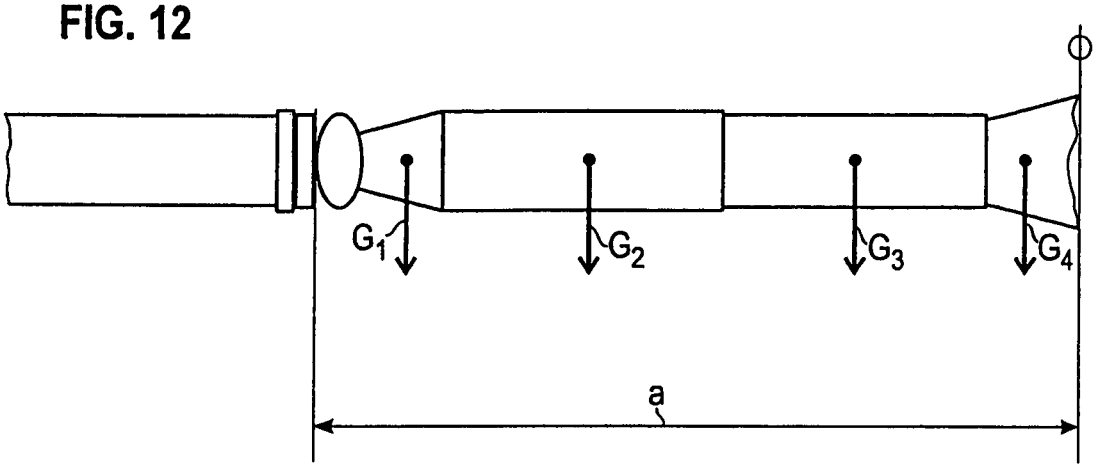
FIGS. 12 and 13: show a schematic representation for explanation of the forces acting during assembly.
Figure 13:
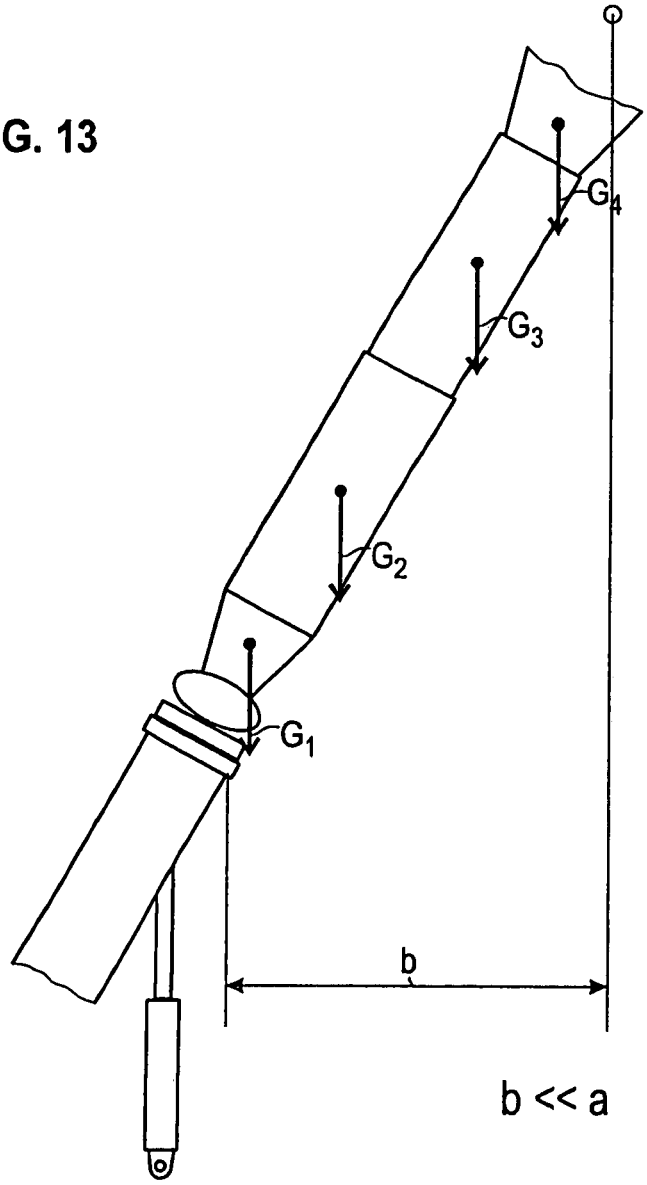

With reference to FIGS. 12 and 13, it is schematically shown which advantages are involved in only extending the telescopic cylinder in the erected position. The forces and moments which here act on the telescopic boom 12 are much smaller (cf. FIG. 13) as compared to telescoping out in the horizontal position (cf. FIG. 12). G1, G2, G3 and G4 each designate the acting weight forces of the individual components attached to the telescopic boom.

The fly jib 20 thus is erected only after the main boom 18 is telescoped out correspondingly and after a corresponding spatial bracing of the main boom 18, with the erected position being shown in FIG. 11.

Advantageously, longer boom systems thus can be erected independently with the present method. The set-up times are reduced, and greater hoisting heights are achieved even if there are disturbing edges. Dismantling the cranes of course is effected in reverse order.

The invention claimed is:

1. A method for erecting a main boom of a truck crane, comprising a longitudinally extending telescopic boom and one or more luffing cylinders for erecting the main boom, and, a fly jib which is braced via bracing trestles and bracing rods, and a Y-shaped spatial boom bracing connected to the telescopic boom and extending laterally outward therefrom out of the plane of the luffing movement, wherein the fly jib is pivotally connected to a detachable foot piece, said foot piece being pivotally connected to the main boom, said method including completely connecting the fly jib to the foot piece at one or more bolting points to fixedly attach the fly jib to the foot piece and prevent relative movement therebetween, wherein the main boom is braced by the spatial bracing before being completely connected with the fly jib.

2. The method according to claim 1, wherein the bracing trestles are mounted to the main boom.

3. The method according to claim 2, wherein the spatial bracing is mounted and tensioned, to connect the isolated foot piece of the fly jib with the fly jib, and the fly jib being movably mounted on one or more carriages.

4. The method according to claim 3, wherein the main boom is brought into a steep position and upon releasing the spatial bracing is telescoped out to the desired length, so that the pivotally mounted end of the fly jib is also lifted and an outer end of the fly jib is rolling freely on the at least one carriage.

5. The method according to claim 4, wherein the telescopic stages of the main boom are bolted to each other and the spatial bracing is tensioned again, before the fly jib is erected.

6. The method according to claim 5, further including applying a supplemental hoisting force to the main boom to assist the erection of the main boom by the one or more luffing cylinders.

7. The method according to claim 2, further including applying a supplemental hoisting force to the main boom to assist the erection of the main boom by the one or more luffing cylinders.

8. The method according to claim 3, further including applying a supplemental hoisting force to the main boom to assist the erection of the main boom by the one or more luffing cylinders.

9. The method according to claim 4, further including applying a supplemental hoisting force to the main boom to assist the erection of the main boom by the one or more luffing cylinders.

10. The method according to claim 1, wherein the spatial bracing is mounted and tensioned, to connect the foot piece of the fly jib with the fly jib, and the fly jib being movably mounted on one or more carriages.

11. The method according to claim 10, wherein the main boom is brought into a steep position and upon releasing the spatial bracing is telescoped out to the desired length, so that the pivotally mounted end of the fly jib is also lifted and the outer end of the fly jib is rolling freely on the at least one carriage.

12. The method according to claim 11, wherein the telescopic stages of the main boom are bolted to each other and the spatial bracing is tensioned again, before the fly jib is erected.

13. The method according to claim 12, further including applying a supplemental hoisting force to the main boom to assist the erection of the main boom by the one or more luffing cylinders.

14. The method according to claim 10, further including applying a supplemental hoisting force to the main boom to assist the erection of the main boom by the one or more luffing cylinders.

15. The method according to claim 11, further including applying a supplemental hoisting force to the main boom to assist the erection of the main boom by the one or more luffing cylinders.

16. The method according to claim 1, further including applying a supplemental hoisting force to the main boom to assist the erection of the main boom by the one or more luffing cylinders.

17. The method according to claim 16, wherein at least one bollard is arranged at the main boom.

18. A method for erecting a main boom of a truck crane, wherein said truck crane comprises the main boom (18), said main boom including a longitudinally extending telescopic boom (12), and a boom extension member (14), one or more luffing cylinders for erecting the main boom (18), a fly jib (20) which is braced by means of bracing trestles (28, 30) and at least one bracing rod (32), and a spatial boom bracing (26) connected to the telescopic boom and extending laterally outward therefrom, said method comprising the steps:

a) pivotally connecting the fly jib (20) to a foot piece (22) at a first connection point;

b) luffing the bracing trestles (28, 30) to lift the foot piece (22);

c) tensioning the spatial bracing (26) to brace the main boom (18); and then, d) fixedly connecting the fly jib (20) to the foot piece (22) at a second connection point to prevent relative movement between the fly jib and the foot piece.

19. The method of claim 18 wherein the bracing trestles (28, 30) are connected to the main boom (18) and the bracing rod (32) is connected between a bracing trestle ((30) and the foot piece (22), said method further comprising step (e):

disconnecting the bracing rod (32) from the foot piece (22) after the fly jib (20) and foot piece (22) are fixedly connected.

20. The method of claim 19 further comprising step (f):

raising and then extending the telescopic boom (12).

21. The method of claim 20 further comprising step (g):

luffing the fly jib (20) after step (f) of raising and then extending the telescopic boom (12).

* * * * *